US005158767A

United States Patent [19]

Cohen et al.

[11] Patent Number: 5,158,767

[45] Date of Patent: Oct. 27, 1992

[54] ATHLETIC SHOE HAVING INFLATABLE BLADDER

[75] Inventors: Eric D. Cohen, Boston; Andrew R. Jones, Roslindale, both of Mass.; Leonardo Servadio, Corciano, Italy

[73] Assignee: Reebok International Ltd., Stoughton, Mass.

[21] Appl. No.: 576,147

[22] Filed: Aug. 30, 1990

Related U.S. Application Data

[63] Continuation of Ser. No. 307,566, Feb. 8, 1989, abandoned, which is a continuation-in-part of Ser. No. 89,749, Aug. 27, 1987, abandoned.

[30] Foreign Application Priority Data

Aug. 29, 1986 [IT] Italy ..... 22853[U]

[51] Int. Cl.[5] ..... A43B 7/14; A43B 5/00

[52] U.S. Cl. ..... 36/88; 36/114; 36/93; 36/29

[58] Field of Search ..... 36/54, 34, 3 R, 3 B, 36/71, 88, 93, 117, 119, 114, 29; 128/588

[56] References Cited

U.S. PATENT DOCUMENTS

| | | | |
|---|---|---|---|
| 806,267 | 12/1905 | King . | |
| 950,333 | 2/1910 | Koch | 36/54 X |
| 1,184,013 | 5/1916 | Pierce | 36/54 |
| 1,216,795 | 2/1917 | Gause | 36/3 A |
| 1,954,122 | 4/1932 | Fiori . | |
| 2,600,239 | 6/1952 | Gilbert . | |
| 2,638,690 | 5/1953 | Bullard, III . | |
| 3,2'3,263 | 9/1966 | Klima | 36/2.5 |
| 3,410,004 | 11/1968 | Finn . | |
| 3,685,176 | 8/1972 | Rudy . | |
| 3,716,930 | 2/1973 | Brahm | 36/3 B |
| 3,744,159 | 7/1973 | Nishimura . | |
| 3,854,228 | 12/1974 | Conroy . | |
| 4,232,459 | 11/1980 | Vaccari . | |
| 4,397,104 | 8/1983 | Doak . | |
| 4,458,429 | 7/1984 | Schmid | 36/54 X |
| 4,583,305 | 4/1986 | Miyamoto . | |
| 4,631,843 | 12/1986 | Annovi . | |
| 4,662,087 | 5/1987 | Beuch | 36/54 X |
| 4,702,022 | 10/1987 | Porcher | 36/93 X |
| 4,730,403 | 3/1988 | Walkhoff . | |
| 4,763,426 | 8/1988 | Polus et al. . | |
| 4,874,640 | 10/1989 | Donzis . | |

FOREIGN PATENT DOCUMENTS

| | | | |
|---|---|---|---|
| 0040189 | 11/1981 | European Pat. Off. . | |
| 152401 | 8/1985 | European Pat. Off. | 36/93 |
| 917173 | 8/1954 | Fed. Rep. of Germany . | |
| 2005365 | 9/1970 | Fed. Rep. of Germany . | |
| 2308547 | 8/1974 | Fed. Rep. of Germany | 36/71 |
| 2365329 | 9/1974 | Fed. Rep. of Germany . | |
| 2456612 | 6/1975 | Fed. Rep. of Germany . | |
| 3427644 | 1/1986 | Fed. Rep. of Germany . | |
| 1204093 | 8/1959 | France . | |
| 2026062 | 9/1970 | France . | |
| 2356384 | 1/1978 | France . | |
| 2496423 | 6/1982 | France | 36/119 |
| 26637 | of 1896 | United Kingdom | 36/54 |
| 23547 | of 1899 | United Kingdom | 36/54 |

*Primary Examiner*—Steven N. Meyers

*Attorney, Agent, or Firm*—Sterne, Kessler, Goldstein & Fox

[57] ABSTRACT

An athletic shoe is described, provided with an inflatable tongue or bladder for a more secure fit to the user's foot. The bladder is inflated with a pump which has a foam material disposed therein.

8 Claims, 6 Drawing Sheets

ATHLETIC SHOE HAVING INFLATABLE BLADDER

This application is a continuation of application Ser. No. 07/307/566, filed Feb. 8, 1989, now abandoned, which is a continuation-in-part, of U.S. Pat. application Ser. No. 89,749, filed Aug. 27, 1987.

FIELD OF THE INVENTION

This invention relates to improved athletic shoes of the type having flexible uppers and, more particularly, to athletic shoes suitable for exercise activities in a gymnasium or on specially equipped fields, for example for basketball.

BACKGROUND OF THE INVENTION

It is known that footwear for sporting purposes must perform as a stable and comfortable support point for the body while subject to various types of stress. It is important that the shoe comfortably fit over the foot. Avoiding, as far as possible, mutual displacements between the footwear and the foot results in less straining of the ankle and other parts of the foot.

It is an object of this invention to provide footwear, which is securely fitted and fastened to the foot of the wearer, whereby a comfortable but secure grip is assured around the ankle and around the instep of the wearer.

Articles of footwear typically include an upper and a sole, and are sold in a variety of sizes according to the length and width of the foot. However, even feet of similar length do not necessarily have the same configuration. Therefore, the upper may be adjustable to accommodate various foot contours. Such adjustment may include medial and lateral side portions which, when tensioned, provide support to the foot. In addition, particularly in the case of athletic footwear, the upper may include an ankle portion which encompasses a portion of the ankle region of the foot and thereby provides support thereto.

The common way to adjust the size of a shoe is through lacing. Lacing alone, however, suffers from several disadvantages, for example, when the shoe laces or strap is drawn too tightly, the fastening system can cause pressure on the instep of the foot. Such localized pressure is uncomfortable to the wearer and can make it difficult for the shoe to be worn for prolonged periods of time. Furthermore, while such fastening systems allow the upper of the shoe to be adjustable to accommodate varying foot and ankle configurations, they do not necessarily mold to the contour of individual feet and thereby provide additional support for the foot. Moreover, no matter how much tension is exerted on the medial and lateral side portion, there still remain areas of the foot which are not supported by the upper, due to the irregular contour of the foot.

Therefore, the need exists for an article of footwear which provides firm, comfortable support to the foot, while also conforming to the foot's irregular contour.

SUMMARY OF THE INVENTION

In accordance with the purposes of the present invention as embodied and described herein, the present invention is an athletic shoe having an inflatable tongue or bladder which fits the anatomical shape of a foot and avoids possible gaps or empty regions between the upper and the foot.

The present invention is an athletic shoe having an upper made of a flexible material. A bladder is disposed within the flexible upper and is in communication with a pump which is formed from a flat bottom layer and a top layer which forms a cavity between the bottom layer and the top layer. A foam member is disposed within the cavity.

In one aspect of the invention, the bladder has a lateral side portion, a medial side portion, and an instep portion.

One advantage provided by the footwear tongue according to this invention is the compensation of the inequalities or bumps due to the interlacement of the laces in the buckling zone. Another advantage of the invention is that a shoe is provided which helps push the heel of a wearer back in the shoe, toward a heel counter.

BRIEF DESCRIPTION OF THE DRAWINGS

The accompanying drawings, which are incorporated in and form a part of the specification, illustrate the embodiments of the present invention and together with the description serve to explain the principles of the invention. In the drawings.

DETAILED DESCRIPTION OF THE PREFERRED EMBODIMENT OF THE INVENTION

Figure 1:
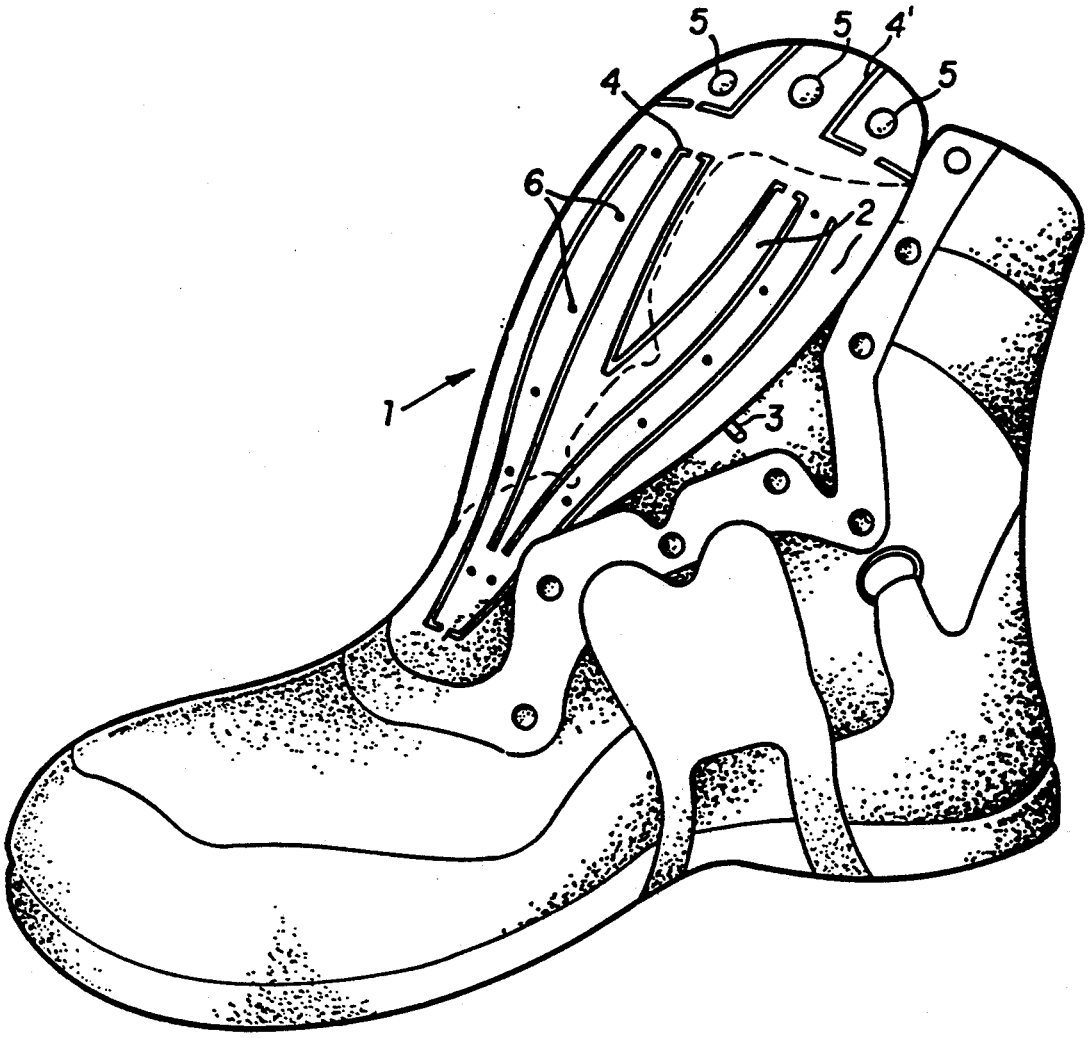
FIG. 1 is a perspective view of footwear provided with the tongue according to this invention.
Figure 2:
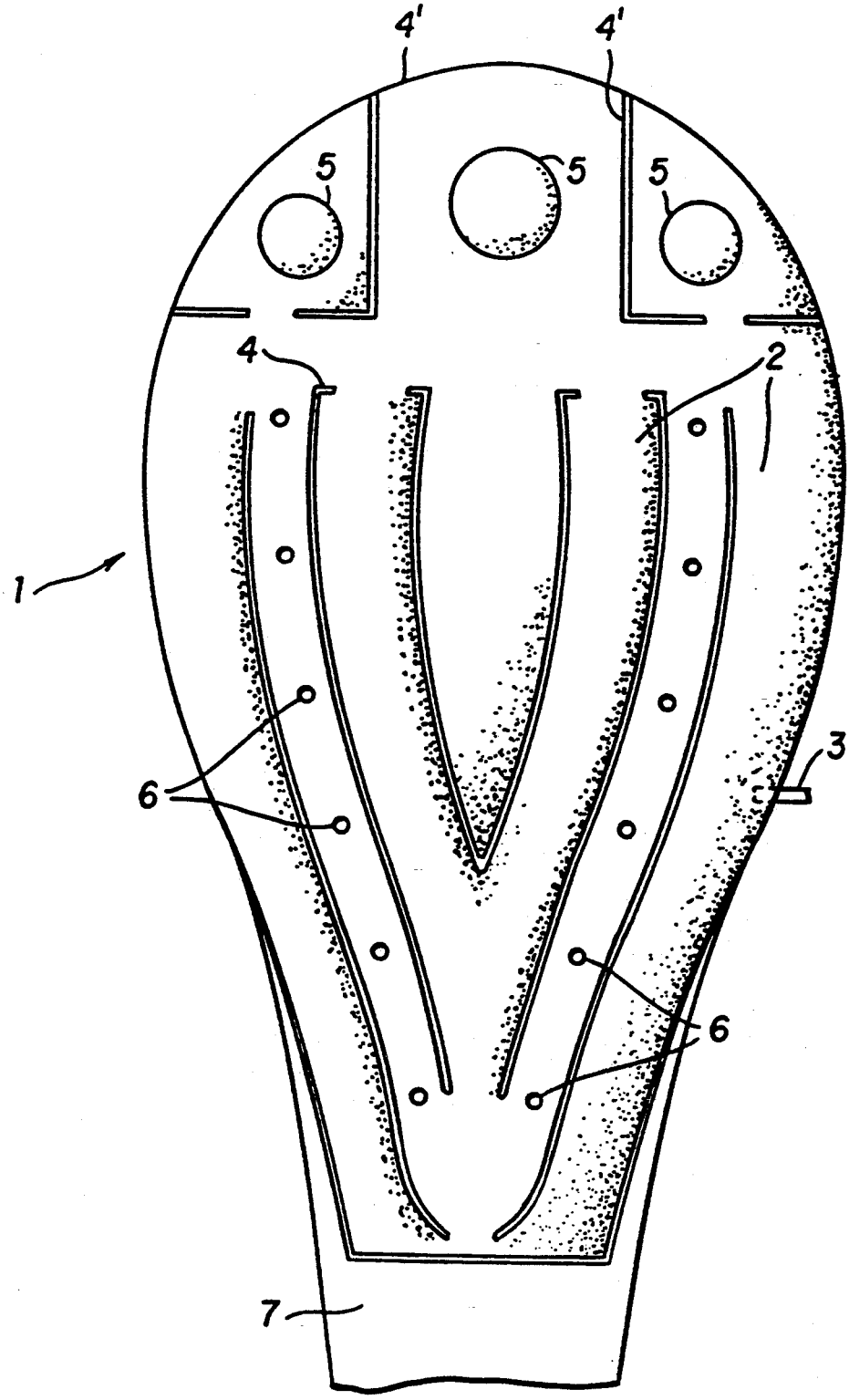
FIG. 2 shows a plan view of the tongue of FIG. 1.

As shown in FIG. 1, the sport footwear of the boot extension type is provided with a double wall tongue 1, within which there are arranged some bags 2 which can be inflated through a small side tube 3 which is in turn provided with a valve for inflating, through a suitable tool. As it is best seen in FIG. 2, inflatable bags 2 may be all mutually connected, whereby pressure is uniformly distributed according to the shape of weld lines 4. Inflatable bags 2 have a slightly curved outline which diverges from the tongue base to the tongue tip, i.e., following the shape of said tongue, while at the free end of tongue 1 weld lines 4' are arranged at right angles in such a way as to define three bags, mutually connected as well, wherein the two lateral side ones are in the shape of quadrants of a circle. In order to avoid that the latter end inflatable bags, after inflating, take an excessively cushion-like shape, due to the position and structure thereof, welding spots or areas 5 are provided in a central region of these end bags respectively.

At the intermediate area of tongue 1, in order to allow for a certain degree of aeration of the foot fitted inside the footwear, two rows of through perforations 6 are provided, whose outline follows the one of the longitudinal inflatable bags 2. The base of the tongue, which must be fastened to the shoe upper, extends into a flap 7 of the same gas-tight material comprising the walls of the inflatable bags 2.

Figure 3:
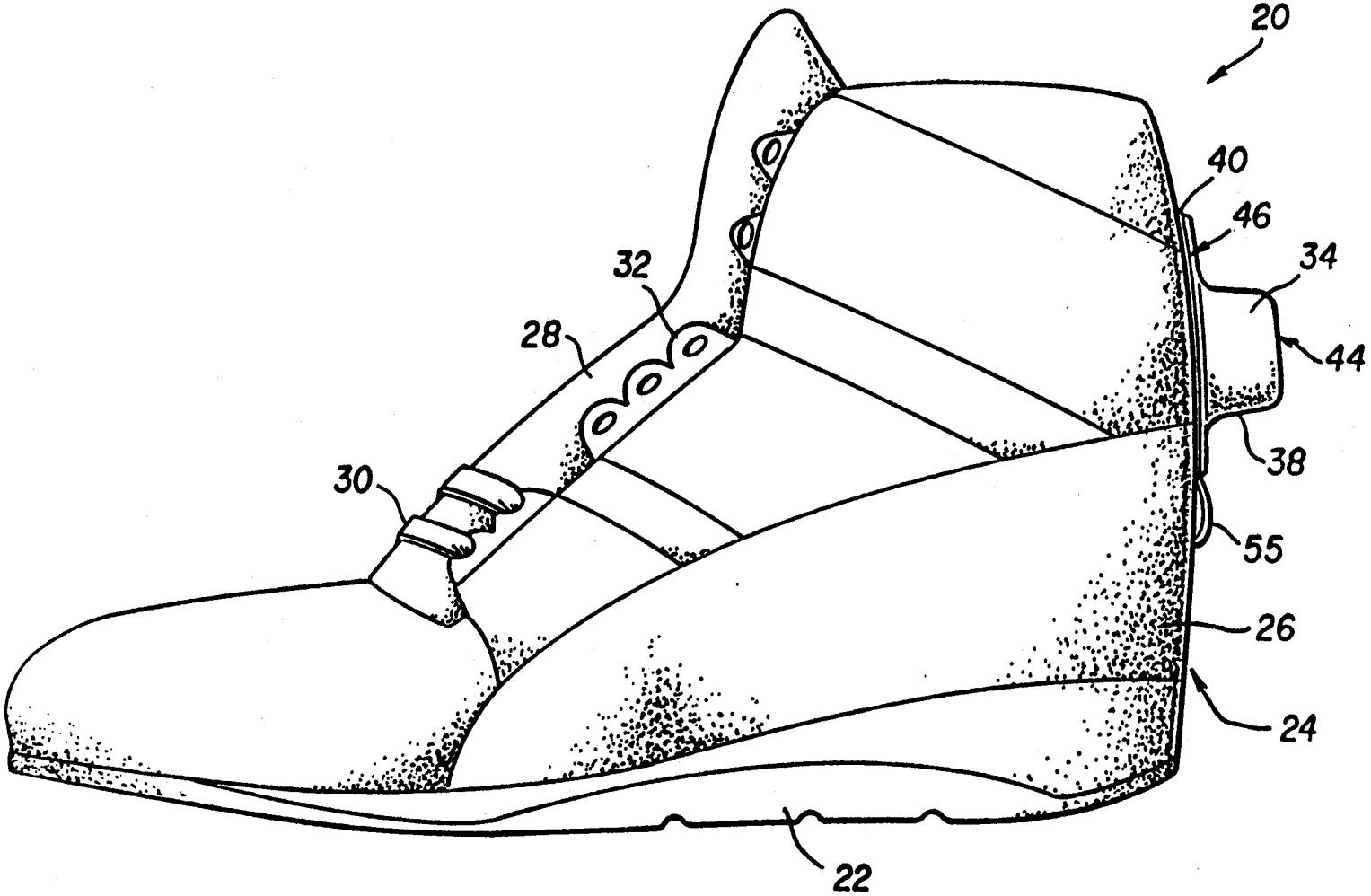
FIG. 3 is another embodiment of an athletic shoe utilizing the present invention.

Referring now to the embodiment of the invention shown in FIGS. 3–7, and in particular to FIG. 3, a shoe is shown generally at 20. Shoe 20 incorporates the support system of the present invention. The support system, which will be discussed in detail below, allows a wearer to select desired pressure.

A variety of shoe structures are capable of incorporating the present invention. However, it is preferred that shoe 20 include a sole, shown generally at 22, and an upper, shown generally at 24. The upper is made primarily from a flexible material such as leather. Upper 24 may be attached to sole 22 by any known methods. FIG. 3 shows a shoe for the left foot. A shoe incorporating the principles of the present invention for the right foot would be substantially a mirror image of FIG. 3. Shoe 20 may include a heel stabilizer 26, a tongue 28, lace 30 and an eyestay 32. Naturally, many modifications can be made to the upper 24 without effecting the operation of the invention. The present invention is a unique device for providing ankle support to the foot of a wearer. In addition, the shoe provides for a custom fit. To provide the support, a system is incorporated into an athletic shoe which enables a user to inflate a bladder to a desired pressure with a conveniently placed pump. The bladder, when inflated, helps push the heel of a wearer toward the back of the shoe, into a heel counter.

Figure 4:
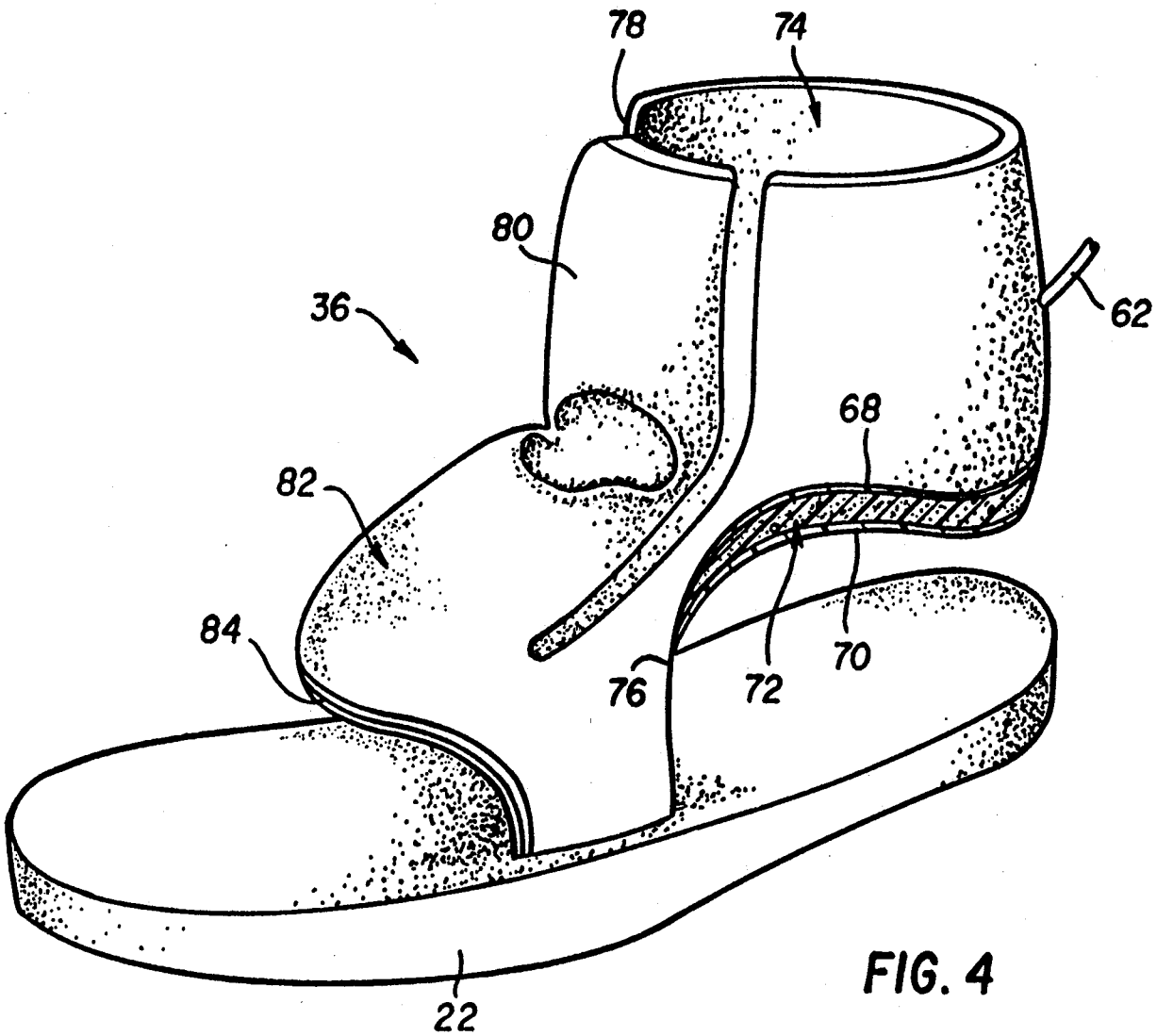
FIG. 4 is a perspective view of the bladder of the present invention.
Figure 5:
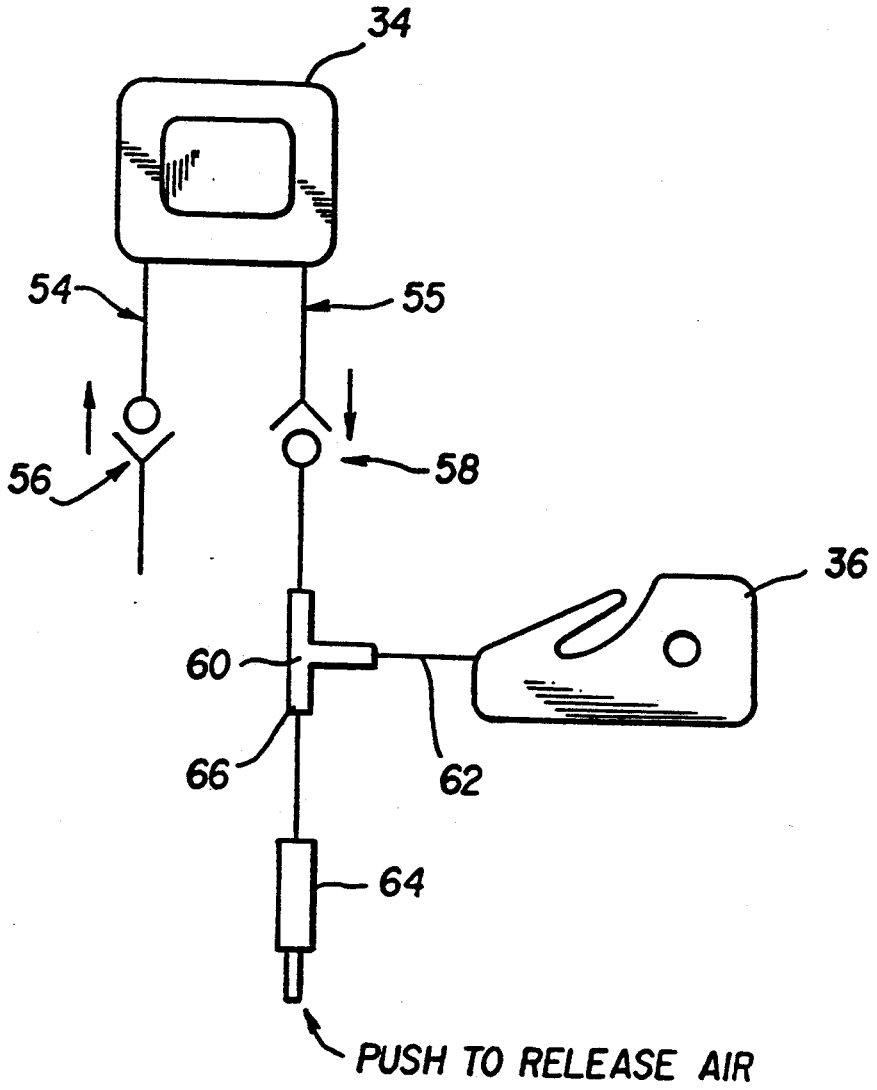
FIG. 5 is a schematic of the pump system utilized in the invention.

Referring now to FIGS. 3–5, a support system of the present invention is shown. This system includes a pump 34 (shown in FIG. 3) which is in fluid communication with inflatable bladder 36 (shown in FIG. 4).

Figure 7:
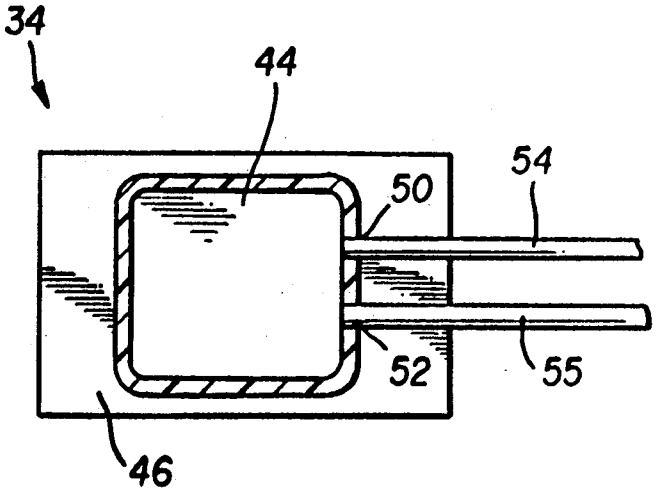
FIG. 7 is a top view of a pump of the present invention.
Figure 6:
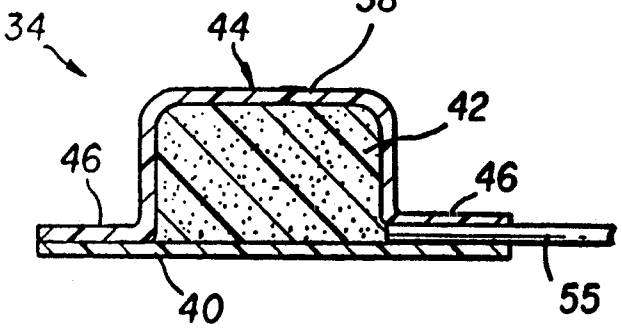
FIG. 6 is a cross-sectional view of an embodiment of a pump of the present invention.

With particular reference to FIGS. 5 and 6–7, a pump 34 is used for inflating bladder 36. Pump 34 includes a top layer 38 and a bottom layer 40, both of which are made from any suitable material, for example, a urethane film. One example of a urethane film which is applicable in the present invention is available from J. P. Stevens & Co., Inc., Northampton, Mass., as product designation MP1880. Disposed between top layer 38 and bottom layer 40 is a foam member 42. The function of foam member 42 is to add resiliency to pump 34. Foam member 42 may be made of any suitable porous material which is capable of allowing fluid to pass therethrough. One example of a suitable material is a polyurethane open-cell foam having 10 to 55 PPI (pores per inch). Such as material is available from United Foam Plastics of Georgetown, Mass. In the alternative, a molded component in a non-compressed state could be substituted for the above-described pump, as could other known pump constructions which would be compatible with the present design. Such a pump could be molded from rubber such as a butyl rubber. If such is the case, the foam member 42 may be eliminated.

The bottom layer 40 of the pump 34 may be a flat sheet of material which forms the side of the pump 34 which lies adjacent to upper 24 as seen in FIG. 1. Top layer 38 is a vacuum formed sheet which is shaped to define a cavity, and foam member 42 is commensurate in size to the cavity and is disposed therein.

The top layer 38 forms a first surface 44 which provides a surface convenient for forcing air from the cavity into bladder 36. The top layer 38 also has edge 46 which provides a surface for suitable attachment to the bottom layer 40. One example of a suitable method of attachment is by the application of high radio frequency (r.f.) to edge 46 and the bottom layer 40. Application of the r.f. will cause the top and bottom layers 38 and 40, respectively, to adhere to one another. However, attachment methods other than r.f. welding are possible.

Referring specifically to FIGS. 6 and 7, pump 34 is shown in which the cavity formed by top layer 38 and bottom layer 40 is approximately 1.0"×1.0"×0.5". The precise size and shape of the pump may be varied. Provided on pump 34 is an inlet port 50 and an outlet port 52. These ports may extend between the top layer 38 and the bottom layer 40 as shown or may extend through either the top layer 38 or bottom layer 40.

The pump 34 will generally be disposed on the upper 24 of athletic shoe 20. In FIG. 3, pump 34 is shown to be located in the back of the shoe with the bottom layer 40 being adjacent or next to the material forming the upper.

The pump 34 is in fluid communication with the atmosphere via inlet tube 54. The outlet tube 56 is in fluid communication with the bladder 36. This can be seen in the schematic representation of the system which is depicted in FIG. 5.

The tubing which may be utilized with the present invention may be comprised of any suitable flexible, small diameter tubing material which is capable of being affixed to pump 34 and bladder 36. One example of tubing which is suitable for use with the present invention is a 1/16 inch I.D.×⅛ inch O.D. clear polyurethane tubing which is available from Industrial Specialties, Inc., Englewood, Colo.

The inlet tube 54 has thereon an inlet check valve 56 which assures that air only flows into pump 34 from the atmosphere. One example of acceptable check valves for use with the present invention is model #2804-401, available from Air Logic, Racine, Wisc. The outlet tube 55 has an exit check valve 58 which ensures that, after bladder 36 is inflated to a desired pressure, air does not flow out of the bladder 36 through pump 34.

As seen with continuing reference to FIG. 5, the outlet tube 55 in connected to a T-connector 60. Naturally, the exact shape of the T-connector 60 need not be a T-shape. The T-connector 60 enables air passing through outlet tube 55 to be in fluid communication with the bladder through a bladder inlet 62. In the embodiment of the invention shown, a release valve 64 is in fluid communication with the bladder 36 to enable venting of the bladder 36. Valve 64 may be attached to an outlet 66 of T-connector 60 or may be affixed directly to the bladder 36.

In operation, the pump 36 is depressed, thereby compressing foam member 42. The air which previously occupied the cavity in the pump 36 is prevented by inlet check valve 56 from escaping to the atmosphere via inlet tube 54. Therefore, the air is forced through outlet tube 55, through check valve 58 and into bladder 36. After the pump 34 is manually depressed, it is released. The foam and the other materials used to form the pump are made of materials with good memory and therefore the pump 34 quickly returns to its predepressed state. As it returns to its shape, ambient air is sucked through inlet tube 54 via the one-way inlet check valve 56, into the cavity of pump 34. The pump is then depressed again and the process is repeated until the bladder 36 is inflated to a desired pressure.

To release pressure, release valve 64 may be depressed to allow air to escape from bladder 36. This release valve 64 may be positioned in a number of different locations as long as it is in fluid communication with the bladder 36.

With reference to FIG. 4, bladder 36 is shown. Bladder 36 may be affixed to upper 24 of shoe 20, it may be affixed to sole 22, or it may be affixed to both upper 24 and sole 22. The bladder 36 is substantially fluid-tight. If affixation is required, it may be accomplished by any known methods, for example stitching and adhesive bonding. It is preferred that bladder 36 encompass at least a portion of the foot of a wearer, and more particularly, encompass at least a portion of the instep and ankle regions of the foot. It may, however, be possible for the bladder to only form the tongue of a shoe, as previously described in reference to FIGS. 1 and 2.

While bladder 36 is not shown in FIGS. 3-7 to be compartmented, individual compartments or fluid receiving chambers could be provided in various areas of bladder 36. One example would be to heat-seal seams along bladder 36. Such seams could also be perforated to allow ventilation to the foot. Such compartments may be interconnected or may be individually inflated by pump 34 or by several pumps.

Bladder 36 is similar in construction to pump 34. That is, bladder 36 is comprised of an interior layer 68 and an exterior layer 70. Both interior layer 68 and exterior layer 70 are comprised of a suitable material, for example, a urethane film such as the one described above with regard to top layer 38 and bottom layer 40 of pump 34. Disposed between interior layer 68 and exterior layer 70 is a foam layer 72. Foam layer 72 may be comprised of any suitable resilient material capable of allowing fluid to pass therethrough. One example is an open-cell foam such as the one described above with regard to foam member 42 of pump 34.

Interior layer 68, foam layer 72 and exterior layer 70 are attached at their edges to form bladder 36. Such attachment may be by any know methods, for example, by high radio frequency which welds the layers together, as described above with regard to pump 34. Alternatively, bladder 36 may form a part of upper 24 such that exterior layer 70 forms the interior of upper 24. Exterior layer 70 may have a brushed or napped surface facing the foot for improved comfort and may form the interior of the upper. Alternatively, a foot compatible liner may be affixed to the foot contacting surface of exterior layer 70.

Continuing with FIG. 4, bladder 36 includes a foot opening 74, through which the foot of a wearer is inserted. Bladder 36 also includes a medial side portion 76, a lateral side portion 78, an instep portion 80, which underlies the tongue 28 of shoe 20, and a forefoot portion 82. Forefoot portion 82 connects medial side portion 76 and lateral side portion 78 with instep portion 80. As shown in FIG. 4, forward end 84 of bladder 36 terminates at a point short of the toe receiving end of sole 22. Alternatively, forward end 82 could extend the full length of sole 22, thereby covering the toes of a wearer, or forward end 82 could also be positioned at any point between the toe and heel receiving ends of sole 22.

Furthermore, while bladder 36 is shown to terminate where it joins sole 22, bladder 36 could extend along the top surface of sole 22, thereby underlying the foot of a wearer. One example of such a configuration would be to extend bladder 36 under the instep region of the foot to provide support and cushioning to the plantar arch.

The air pressure within bladder 36 affords support to the foot of a wearer otherwise unavailable from upper 28 alone. Furthermore, bladder 40 provides increased cushioning to the foot by molding to the particular contour of the foot and thereby, accommodating for anatomical irregularities inherent in the human foot. Therefore, bladder 36 allows the wearer individualized interior sizing of shoe 20.

Additionally, bladder 36 prevents uncomfortable localized pressure from the fastening system of the shoe by providing a cushion between the foot and the fastening system. Bladder 36 provides uniform cushioning by which pressure from the fastening system is distributed across bladder 36.

The foregoing description of the preferred embodiments of the invention have been presented for purposes of illustration and description. It is not intended to be exhaustive or to limit it to the precise form disclosed. Obviously, many modifications and variations may be made in light of the above teachings.

The embodiments were chosen and described in order to best explain the principles of the invention and its practical application to thereby enable others skilled in the art to best utilize the invention in various embodiments and with various modifications as are suited to the particular use contemplated. For example, a bladder may be designed which conforms to parts of the foot other than those parts specified above. It is contemplated, for instance, that the invention may be utilized to be used under the sole of a user. It is intended that the scope of the invention be defined by the claims appended hereto.

What I claim is:

1. An athletic shoe, comprising:

(a) a sole;

(b) an upper having a tongue and means for lacing said upper, said upper being attached to said sole and being made of a flexible material;

(c) a pump substantially permanently affixed to said upper; and (d) a bladder at least a portion of which is associated with said flexible tongue and in fluid communication with said pump, said bladder being substantially fluid tight, and said bladder including an interior layer made of a substantially flat film material and an exterior layer made of a substantially flat film material, wherein said interior layer and said exterior layer are substantially the same size and are welded together along their periphery to form said bladder and wherein said interior layer and said exterior layer are further attached together along at least one weld line which extends in substantially the same direction as the longitudinal axis of said tongue.

2. The athletic shoe of claim 1, wherein said bladder has an interior layer, an exterior layer, and a foam layer disposed between said interior layer and said exterior layer.

3. The athletic shoe of claim 2, wherein said interior layer comprises urethane.

4. The athletic shoe of claim 2, wherein said exterior layer comprises urethane.

5. An athletic shoe, comprising:

a. a sole, said sole including an outsole made of an abrasive resistent material which is suitable for contacting the ground;

b. an upper having a tongue, said upper being oriented to receive the foot of a wearer and being made of a flexible material, wherein said upper is attached to said sole;

c. a bladder disposed within said upper and at least a portion of said bladder being disposed within said tongue, said bladder having an interior layer made of a substantially flat film and an exterior layer made of a substantially flat film, said interior and exterior layers being welded together along their periphery and defining a volume, said bladder having a plurality of weld spots attaching said interior layer and said exterior layer to each other; and d. a pump, said pump being substantially fixed to said upper, said pump in fluid communication with said bladder and oriented to enable a user to manually introduce fluid into the bladder.

6. An athletic shoe having an upper and a sole, wherein the upper is made substantially of a flexible material, and wherein the upper has a medial side, a lateral side, a tongue, a means for selectively drawing the medial side of the upper and the lateral side of the upper together, and wherein the sole includes a heel region, a toe region and an intermediate region disposed between said heel region and said toe region wherein the heel region, the toe region and the intermediate region each have lowermost surfaces and wherein there is a substantially smooth transition between the lowermost surface of said heel region and the lowermost surface of said intermediate region, the improvement comprising: an inflatable bladder disposed within said upper and a pump substantially permanently affixed to said upper for inflating said bladder with air.

7. The athletic shoe of claim 6 wherein said pump comprises a molded rubber material.

8. The athletic shoe of claim 6 wherein said upper includes a back portion and wherein said pump is affixed to the back portion of said upper.

* * * * *